United States Patent [19]

Klempirik

[11] 4,445,555

[45] May 1, 1984

[54] WOOD SPLITTING TOOL

[76] Inventor: Victor L. Klempirik, 540 E. Bennington Rd., Owosso, Mich. 48867

[21] Appl. No.: 332,540

[22] Filed: Dec. 21, 1984

Related U.S. Application Data

[63] Continuation-in-part of Ser. No. 292,197, Aug. 10, 1981, abandoned.

[51] Int. Cl.[3] ..... B27L 7/00; B26B 23/00

[52] U.S. Cl. ..... 144/193 D; 145/2 R; 254/104

[58] Field of Search ..... 144/193 P, 193 C, 193 D, 144/193 E, 366; 254/104; 145/2 R

[56] References Cited

U.S. PATENT DOCUMENTS

| | | | |
|---|---|---|---|
| 1,192,185 | 7/1916 | Gravel | 254/104 |
| 1,356,413 | 10/1920 | Staub | 254/104 |
| 1,380,559 | 6/1921 | Jespersen | 254/104 |
| 4,103,723 | 8/1978 | Carmichael | 144/193 D |
| 4,194,544 | 3/1980 | Scott et al. | 254/104 |
| 4,209,046 | 6/1980 | Lavigne | 254/104 |
| 4,295,506 | 10/1981 | Nicholson | 144/193 D |
| 4,357,974 | 11/1982 | Nannen | 144/193 D |

FOREIGN PATENT DOCUMENTS

| | | | |
|---|---|---|---|
| 185266 | 4/1956 | Austria | 144/193 D |
| 1045360 | 6/1953 | France | 144/193 D |

*Primary Examiner*—W. D. Bray

*Attorney, Agent, or Firm*—Malcolm R. McKinnon

[57] ABSTRACT

An improved wood splitting tool which incorporates improved multiple wedge means adapted to engage the wood with successively increasing wedge angles and decreasing area contact whereby the efficiency of the wood splitting tool is increased and wood of various varieties and sizes may be split with a minimum of force.

24 Claims, 13 Drawing Figures

FIG. 6.
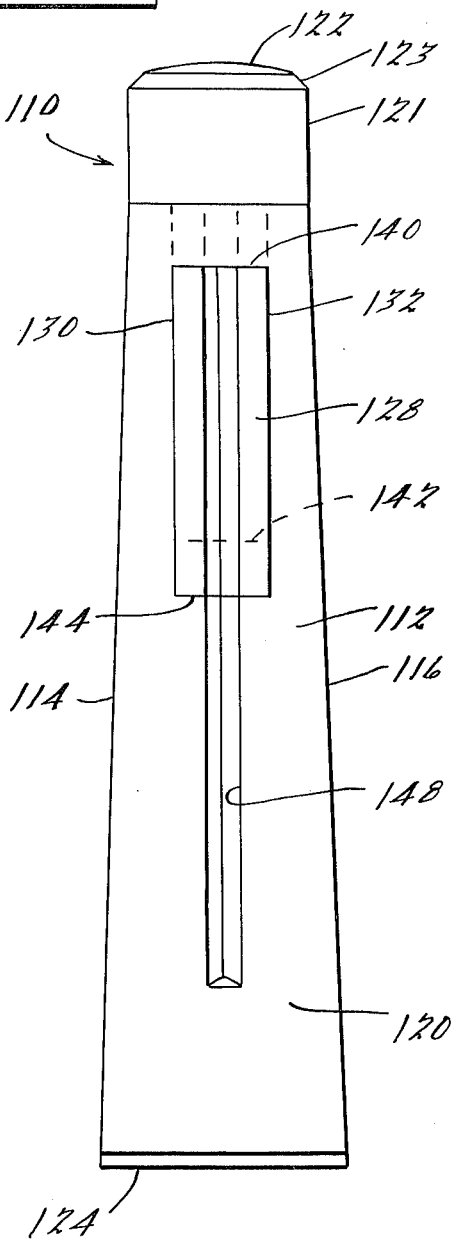
FIG. 7.
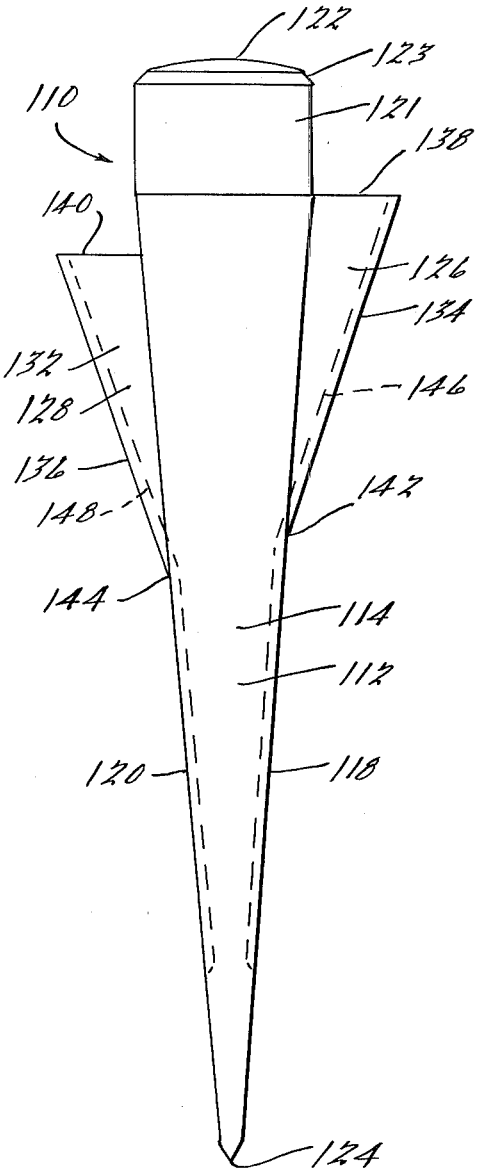
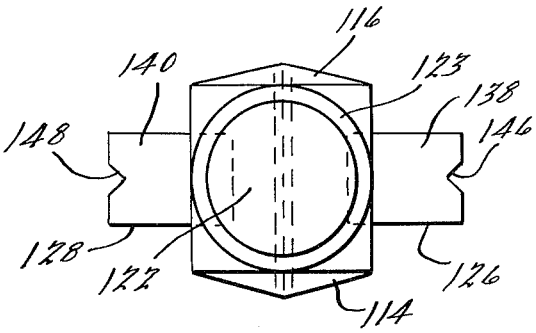
FIG. 8.
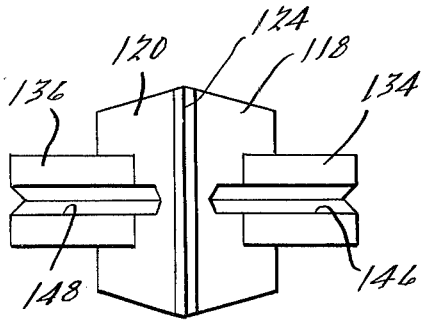
FIG. 9.

WOOD SPLITTING TOOL

This application is a continuation-in-part of the applicant's co-pending application, Ser. No. 06/292,197, filed Aug. 12, 1981, for Wood Splitting Tool now abandoned.

BRIEF SUMMARY OF THE INVENTION

This invention relates to wood splitting tools and, more particularly, to an improved wood splitting tool incorporating improved wedge means for splitting wood which increases the efficiency of the wood splitting tool and enables the splitting of wood, such as logs of various varieties and diameters, with a minimum of force. Heretofore, many types of devices have been provided for splitting wood. An object of the present invention is to overcome deficiencies in prior wood splitting devices and to provide an improved wood splitting tool incorporating improved multiple wedge means adapted to successively engage the wood which is to be split and which enables the splitting of wood of various varieties and sizes with a minimum of force.

Another object of the present invention is to provide an improved wood splitting tool which may be utilized to split wood by the application of manual force to the tool, such as with a sledge hammer, which may be incorporated as a wood splitting head in apparatus utilizing hydraulic, pneumatic or mechanical means to apply force to the wood splitting head, or which may be provided with handle means to facilitate the application of manual force to the tool.

Another object of the present invention is to provide an improved wood splitting tool that is relatively simple in construction, economical to manufacture, durable, efficient and reliable in operation.

The above as well as other objects and advantages of the present invention will become apparent from the following description, the appended claims and the accompanying drawings.

BRIEF DESCRIPTION OF THE DRAWINGS

FIG. 6 is a side elevational view of another embodiment of the invention;

FIG. 7 is an end elevational view of the wood splitting tool illustrated in FIG. 6;

FIG. 8 is a top plan view of the wood splitting tool illustrated in FIG. 7;

FIG. 9 is a bottom plan view of the wood splitting tool illustrated in FIG. 7;

DETAILED DESCRIPTION

Figure 1:
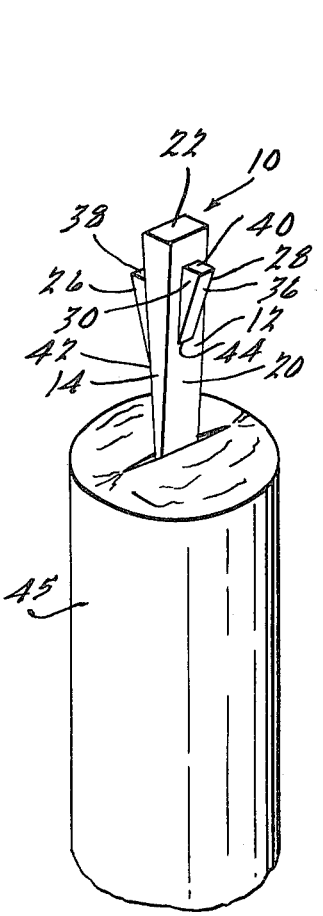
FIG. 1 is a perspective view of a wood splitting tool embodying the present invention, showing the same as it is initially driven into a log.
Figure 2:
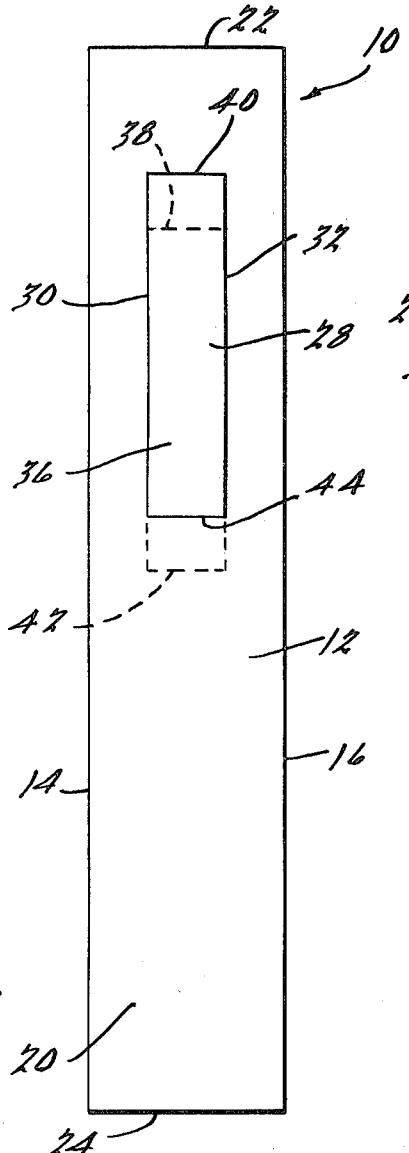
FIG. 2 is an enlarged side elevational view of the wood splitting tool illustrated in FIG. 1, taken from the right of FIG. 1.
Figure 3:
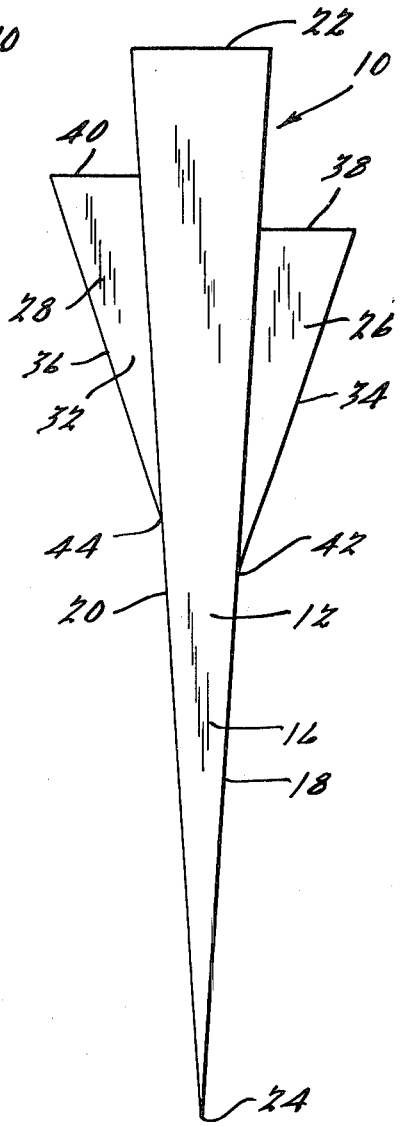
FIG. 3 is an end elevational view of the wood splitting tool illustrated in FIG. 2.
Figure 4:
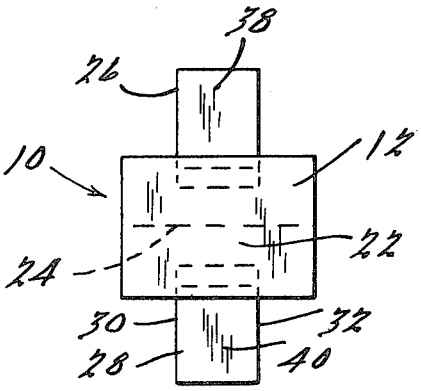
FIG. 4 is a top view of the wood splitting tool illustrated in FIG. 2.
Figure 5:
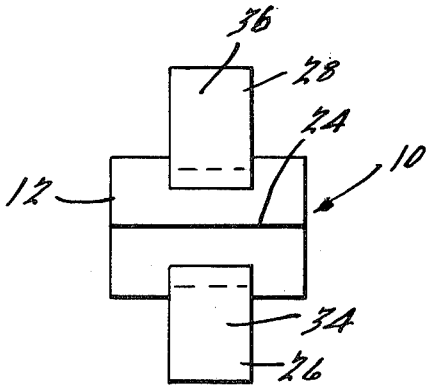
FIG. 5 is a bottom view of the wood splitting tool illustrated in FIG. 2.

Referring to the drawings, one embodiment of the invention is illustrated in FIGS. 1 through 5 thereof, and is comprised of a wood splitting tool, generally designated 10, that includes an elongate, solid body portion 12 which is of wedge shaped configuration and which includes a pair of spaced, substantially parallel end surfaces 14 and 16 each of which is of generally isosceles triangular configuration. The body portion 12 also includes a pair of oppositely angularly inclined side surfaces 18 and 20 which are of generally rectangular configuration and a top surface 22 which is also of generally rectangular configuration. The oppositely angularly inclined side walls 18 and 20 slope toward each other and terminate in a relatively sharp edge 24 at the apex of the isosceles triangularly configured end walls 14 and 16 of the body portion 12.

A pair of longitudinally offset, solid flank portions 26 and 28 are provided which may be fabricated as separate pieces and welded or otherwise fixed to the body portion 12 or which may be formed integrally with the body portion 12, as by forging the wood splitting tool 10 from a single piece of stock. Each of the flank portions 26 and 28 includes spaces, substantially parallel end surfaces 30 and 32 which are of generally obtuse triangular configuration. The flank portions 26 and 28 also include oppositely angularly inclined side surfaces 34 and 36, respectively, and substantially square top surfaces 38 and 40, respectively.

As shown in the drawings, the flank portions 26 and 28 are disposed on the oppositely angularly inclined side walls 18 and 20, respectively, of the body portion 12 intermediate and substantially equally spaced from the end walls 14 and 16 of the body portion 12. The flank portion 26 is also longitudinally offset on the body portion 12 with respect to the flank portion 28 so that the apex 42 of the flank portion 26 is disposed below the apex 44 of the flank portion 28 as viewed in the drawings.

In this embodiment of the invention, the oppositely angularly inclined surfaces 18 and 20 of the body portion 12 are each disposed at an angle of approximately four degrees from the vertical. That is to say, the included angle between the surfaces 18 and 20 is approximately eight degrees. In this embodiment of the invention, the oppositely angularly inclined surfaces 34 and 36 of the flank portions 26 and 28, respectively, are each disposed at an angle of approximately eighteen degrees from the vertical. Thus, the included angle between the inclined surface 18 of the body portion 12 and the inclined surface 34 of the flank portion 26 is approximately fourteen degrees and the included angle between the inclined surface 20 of the body portion 12 and the inclined surface 36 of the flank portion 28 is also approximately fourteen degrees. The width of the inclined surfaces 34 and 36 of the flank portions 26 and 28, respectively, is approximately one-third the width of the inclined surfaces 18 and 20 of the body portion 12. For example, the width of the inclined surfaces 34 and 36 (the distance between the surfaces 30 and 32) may be approximately three-fourths of an inch when the width of the inclined surfaces 18 and 20 (the distance between the surfaces 14 and 16) is approximately two inches.

The body portion 12 and the flank portions 26 and 28 are preferably formed of steel or other suitable material having sufficient strength to withstand the forces exerted thereon and, as previously mentioned, may be formed as separate pieces which are welded or otherwise fixed together to form a unitary structure, or may be forged or otherwise shaped from a single piece of stock material.

In use, the wood splitting tool 10 is initially positioned with the edge 24 disposed against one end of the wood, such as the log 45, which is to be split. Suitable force is then applied to the wood splitting tool 10, as by impacting a sledge hammer against the end surface 22 of the body portion 12 or by utilizing hydraulic, pneumatic or mechanical means to apply force longitudinally of the tool 10 so as to drive the wood splitting tool 10 into wood. As the wood splitting tool 10 is progressively driven into the wood, the oppositely angularly inclined surfaces 18 and 20 of the body portion 12 split the wood with a wedging angle of approximately eight degrees thereby facilitating relatively easy penetration of the wood. As the wood splitting tool 10 is progressively driven further into the wood, the apex 42 of the flank portion 26 penetrates the wood thereby increasing the wedging angle. At the same time, the area of the wedging surfaces of the tool which engage the wood is abruptly reduced. Subsequently, the apex 44 of the flank portion 28 penetrates the wood so as to again increase the wedging angle while at the same time abruptly reducing the area of the tool which engages the wood, the area of the surfaces 34 and 36 on the flank portions 26 and 28 being substantially less than the area of the surfaces 18 and 20 on the body portion 12.

It has been found that the wood splitting tool 10 may be driven easily and quickly into wood of various varieties and diameters so as to split the wood, such as logs, with a minimum of force. Furthermore, with the above described construction, the tool 10 may be driven completely throughout the length of the log since the flank portions 26 and 28 spread the wood outwardly beyond the upper sections of the side surfaces 18 and 20 of the body portion 12 thereby permitting engagement of the top surface 22 of the body portion 12 by the head of a sledge hammer or other force applying means. That is to say, the flank portions 26 and 28 provide clearance for the body portion 12 so that the head of a sledge hammer or other force applying means may be applied to the top surface 22 of the body portion 12 as the tool 10 is driven throughout the length of a log during the splitting operation, and even though the tool 10 is disposed completely within the log. In addition, with the above described construction, when the flank portions 26 and 28 are fabricated as separate units and thereafter welded or otherwise fixed to the body portion 12 in the manner previously described, the flank portions 26 and 28 may be fabricated as identical pieces thereby reducing the cost of manufacture of the tool 10.

Another embodiment of the invention is illustrated in FIGS. 6 through 9, and is comprised of a wood splitting tool, generally designated 110, that includes an elongate, solid body portion 112 which is of generally wedge shaped configuration and which includes a pair of spaced, oppositely angularly inclined end surfaces 114 and 116 each of which is of generally isosceles triangular configuration, the end surfaces 114 and 116 sloping downwardly and outwardly away from each other. The body portion 112 also includes a pair of oppositely angularly inclined side surfaces 118 and 120 which are of generally trapezoidal configuration, and an integral, generally cylindrical head portion 121 terminating in a convex or crowned circular top surface 122, the area of the head portion 121 adjacent the top surface 122 preferably being beveled as at 123. The oppositely angularly inclined side surfaces 118 and 120 slope downwardly toward each other and are sharpened so as to terminate in a relatively sharp edge 124 at the apex of the isosceles triangularly configured end walls 114 and 116 of the body portion 112.

A pair of longitudinally offset, solid flank portions 126 and 128 are provided which may be fabricated as separate pieces and welded or otherwise fixed to the body portion 112 or which may be formed integrally with the body portion 112, as by forging the wood splitting tool 110 from a single piece of stock. Each of the flank portions 126 and 128 includes spaced, substantially parallel end surfaces 130 and 132 which are of generally obtuse triangular configuration. The flank portions 126 and 128 also include oppositely angularly inclined side surfaces 134 and 136, respectively, and substantially rectangular top surfaces 138 and 140, respectively.

As shown in FIGS. 6 through 9, the flank portions 126 and 128 are disposed on the oppositely angularly inclined side walls 118 and 120, respectively, of the body portion 112 intermediate and substantially equally spaced from the end walls 114 and 116 of the body portion 112. The flank portion 126 is also longitudinally offset on the body portion 112 with respect to the flank portion 128 so that the apex 142 of the flank portion 126 is disposed above the apex 144 of the flank portion 128 as viewed in the drawings.

In this preferred embodiment of the invention, the oppositely angularly inclined surfaces 118 and 120 of the body portion 112 are also each disposed at an angle of approximately four degrees from the vertical. That is to say, the included angle between the surfaces 118 and 120 is approximately eight degrees. In this embodiment of the invention, the oppositely angularly inclined surfaces 134 and 136 of the flank portions 126 and 128, respectively, are also each disposed at an angle of approximately eighteen degrees from the vertical. Thus, the included angle between the inclined surface 118 of the body portion 112 and the inclined surface 134 of the flank portion 126 is approximately fourteen degrees and the included angle between the inclined surface 120 of the body portion 112 and the inclined surface 136 of the flank portion 128 is also approximately fourteen degrees. The width of the inclined surfaces 134 and 136 of the flank portions 126 and 128, respectively, is approximately one-third of the maximum width of the inclined surfaces 118 and 120 of the body portion 112. For example, the width of the inclined surfaces 134 and 136 (the distance between the surfaces 130 and 132) may be approximately three-fourths of an inch when the maximum width of the inclined surfaces 118 and 120 (the distance between the surfaces 114 and 116 at the edge 124) is approximately two inches.

In this embodiment of the invention an elongate groove 146 is provided in the angularly inclined side surfaces 118 and 134 of the tool 110 and an elongate groove 148 is provided in the angularly inclined side surfaces 120 and 136 of the tool, the grooves 146 and 148 being generally V-shaped in transverse cross section and being aligned with the centerline of the surfaces 118, 120, 134 and 136. The upper end portions of the grooves 146 and 148 preferably intersect the surfaces 138 and 140, respectively, while the lower end portions of the grooves 146 and 148 preferably terminate above the sharp edge 124 at a distance approximately equal to the length of the edge 124. By way of illustration, the V-shaped grooves 146 and 148 may be approximately 3/32 of an inch deep. Such a construction serves to guide the tool 110 in a straight line path as the tool is driven into the wood.

The body portion 112 and the flank portions 126 and 128 are preferably formed of steel or other suitable material having sufficient strength to withstand the forces exerted thereon and, as previously mentioned, may be formed as separate pieces which are welded or otherwise fixed together to form a unitary structure, or may be forged or otherwise shaped from a single piece of stock material.

In the operation of this embodiment of the invention, the wool splitting tool 110 is initially positioned with the edge 124 disposed against one end of the wood which is to be split. Suitable force is then applied to the wood splitting tool 110, as by impacting a sledge hammer against the end surface 122 of the tool or by utilizing hydraulic, pneumatic or mechanical means to apply force longitudinally of the tool 110 so as to drive the wood splitting tool 110 into the wood. As the wood splitting tool 110 is progressively driven into the wood, the oppositely angularly inclined surfaces 118 and 120 of the body portion 112 split the wood with a wedging angle of approximately eight degrees thereby facilitating relatively easy penetration of the wood. As the wood splitting tool 110 is progressively driven further into the wood, the apex 144 of the flank portion 128 penetrates the wood thereby increasing the wedging angle. At the same time, the area of the wedging surfaces of the tool which engage the wood is abruptly reduced. Subsequently, the apex 142 of the flank portion 126 penetrates the wood so as to again increase the wedging angle while at the same time abruptly reducing the area of the tool which engages the wood, the area of the surfaces 134 and 136 on the flank portions 126 and 128 being substantially less than the area of the surfaces 118 and 120 on the body portion 112. As the tool 110 is driven into the wood, the edges and surfaces of the tool defining the grooves 146 and 148 serve to guide the tool in a straight line path through the wood.

It has been found that the wood splitting tool 110 may be driven easily and quickly into wood of various varieties and diameters so as to split the wood, such as logs, with a minimum of force. Furthermore, with the above described construction, the tool 110 may be driven completely throughout the length of a log since the flank portions 126 and 128 spread the wood outwardly beyond the upper sections of the side surfaces 118 and 120 of the body portion 112 thereby permitting engagement of the crowned surface 122 of the body portion 112 by the head of a sledge hammer or other force applying means. That is to say, the flank portions 126 and 128 provide clearance for the body portion 112 so that the head of a sledge hammer or other force applying means may be applied to the crowned surface 122 of the body portion 112 as the tool is driven throughout the length of a log during the splitting operation, and even though the tool 110 is disposed completely within the log. In addition, with the above described construction, when the flank portions 126 and 128 are fabricated as separate units and thereafter welded or otherwise fixed to the body portion 112 in the manner previously described, the flank portions 126 and 128 may be fabricated as identical pieces thereby reducing the cost of manufacture of the tool 110.

Figure 10:
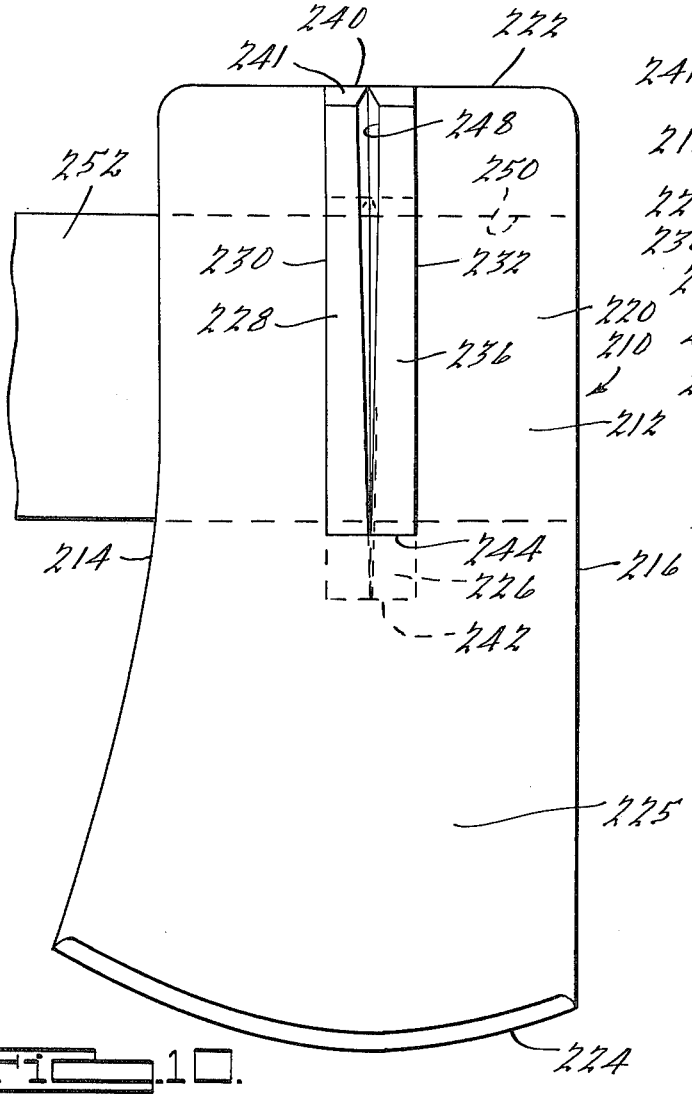
FIG. 10 is a side elevational view of another embodiment of the invention.
Figure 11:
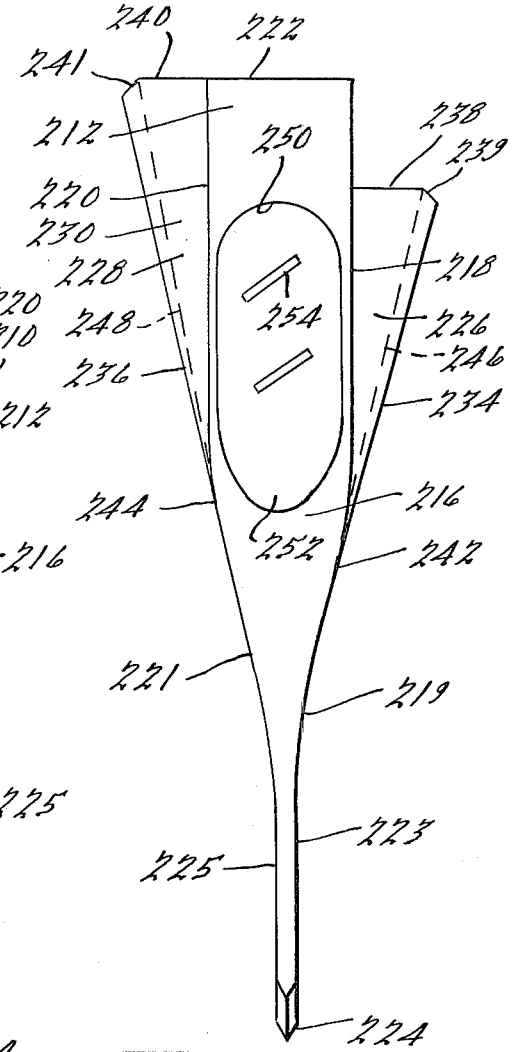
FIG. 11 is an end elevational view of the wood splitting tool illustrated in FIG. 10.
Figure 12:
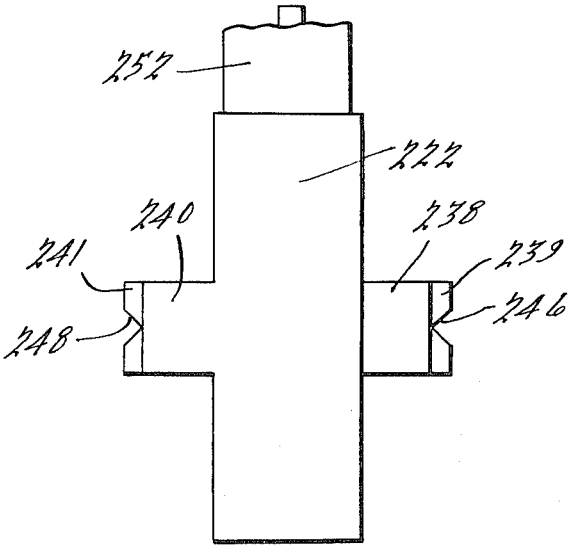
FIG. 12 is a top plan view of the wood splitting tool illustrated in FIG. 11.
Figure 13:
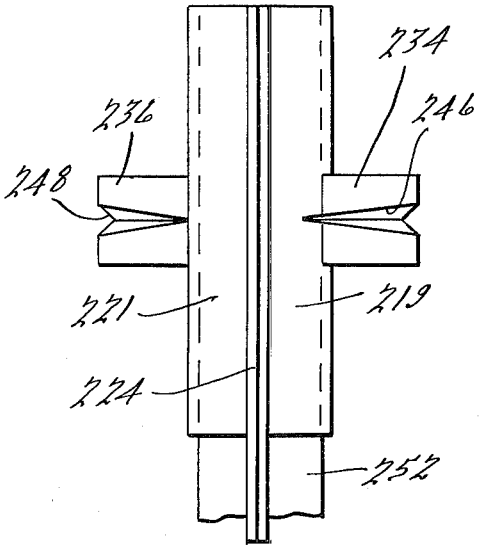
FIG. 13 is a bottom plan view of the wood splitting tool illustrated in FIG. 11.

Another embodiment of the invention is illustrated in FIGS. 10 through 13 and is comprised of a wood splitting tool, generally designated 210, that includes a solid body portion 212 having a wedge shaped configuration in the form of an ax or hatchet head. The body portion 212 includes spaced end surfaces 214 and 216. The body portion 212 also includes side surfaces 218 and 220 and a top surface 222 which is of generally rectangular configuration. The side surfaces 218 and 220 include portions 219 and 221 which slope toward each other and merge smoothly with portions 223 and 225 that extend in spaced, substantially parallel relationship and terminate in a relatively sharp edge 224.

A pair of longitudinally offset, solid flank portions 226 and 228 are provided which are preferably formed integrally with the body portion 212, as by forging the wood splitting tool 210 from a single piece of stock. Each of the flank portions 226 and 228 includes spaced, substantially parallel end surfaces 230 and 232 which are of generally triangular configuration. The flank portions 226 and 228 also include oppositely angularly inclined side surfaces 234 and 236, respectively, and substantially square top surfaces 238 and 240, respectively, the upper edges of the flank portions preferably being beveled as at 239 and 241.

As shown in the drawings, the flank portions 226 and 228 project outwardly from the side walls 218 and 220, respectively, of the body portion 212 intermediate and substantially equally spaced from the end surfaces 214 and 216 of the body portion 212. The flank portion 226 is also longitudinally offset on the body portion 212 with respect to the flank portion 228 so that the apex 242 of the flank portion 226 is disposed below the apex 244 of the flank portion 228 as viewed in the drawings.

As shown in FIGS. 10 through 13, in this embodiment of the invention, a relatively thin entry section is provided for the tool 210, the entry section being defined by the portions 223 and 225 of the side surfaces 218 and 220 which extend substantially parallel to the vertical and merge smoothly with the oppositely angularly inclined portions 219 and 221 that are each inclined at an angle of approximately twelve degrees from the vertical. In this embodiment of the invention, the oppositely angularly inclined surfaces 234 and 236 of the flank portions 226 and 228, respectively, are each disposed at an angle of approximately eighteen degrees from the vertical. Thus, the included angle between the inclined surface portion 219 of the body portion 212 and the inclined surface 234 of the flank portion 226 is approximately six degrees and the included angle between the inclined surface portion 221 of the body portion 212 and the inclined surface 236 of the flank portion 228 is also approximately six degrees. The width of the inclined surfaces 234 and 236 of the flank portions 226 and 228, respectively, is approximately one-fifth of the minimum distance between the surfaces 214 and 216 of the body portion 212. For example, the width of the inclined surfaces 234 and 236 (the distance between the surfaces 230 and 232) may be approximately five-eights of an inch when the minimum width of the surfaces 218 and 220 (the minimum distance between the surfaces 214 and 216) is approximately three inches.

In this embodiment of the invention an elongate tapered groove 246 is provided in the angularly inclined side surface portions 219 and 234 of the tool 210 and an elongate tapered groove 248 is provided in the angularly inclined surface portions 221 and 236 of the tool, the grooves 246 and 248 being generally V-shaped in transverse cross section and being aligned with the centerline of the surfaces 219, 221, 234 and 236. The upper end portions of the grooves 246 and 248 preferably intersect the surfaces 238 and 240, respectively. The grooves 238 and 240 taper, i.e., become narrower and shallower in the direction toward the edge 224, and the lower end portions of the grooves 246 and 248 preferably terminate above the sharp edge 224 at a distance approximately equal to the minimum width of the surfaces 218 and 220. By way of illustration, the V-shaped grooves 246 and 248 may be approximately 3/32 of an inch deep at their maximum depth with the groove 246 terminating approximately three inches above the edge 224 when the minimum width of the surfaces 218 and 220 is also approximately three inches. The groove 248 may then terminate approximately one-half of an inch above the termination of the groove 245. Such a construction serves to guide the tool 210 in a straight line path as the tool is driven into the wood.

In this embodiment of the invention, the body portion 212 defines a passageway 250 adapted to receive a conventional ax or hatchet handle 252, the handle being retained in the passageway 250 through the agency of conventional wedges 254 or other suitable means. The body portion 210 and the flank portions 226 and 228 are preferably formed of steel or other suitable material having sufficient strength to withstand the forces exerted thereon and, as previously mentioned, are preferably forged or otherwise shaped as a unitary structure from a single piece of stock material, although it will be understood that the body portion and the flank portions may be formed as separate pieces which are welded or otherwise fixed together to form a unitary structure.

In the use of this embodiment of the invention, the tool 210 is utilized in the same manner as an ax or hatchet, suitable manual force being applied through the agency of the handle 252. As the wood splitting tool 210 is progressively driven into the wood, the surface portions 223, 225, 219 and 221 initially split the wood with a relatively small wedging angle thereby facilitating relatively easy penetration of the wood. As the wood splitting tool 210 is progressively driven further into the wood, the apex 242 of the flank portion 226 penetrates the wood thereby increasing the wedging angle. At the same time, the area of the wedging surfaces of the tool which engage the wood is abruptly reduced. Subsequently, the apex 244 of the flank portion 228 penetrates the wood so as to again increase the wedging angle while at the same time abruptly reducing the area of the tool which engages the wood, the area of the surfaces 234 and 236 on the flank portions 226 and 228 being substantially less than the area of the surfaces 223, 225, 219 and 221 on the body portion 212.

It has been found that the wood splitting tool 210 may be driven easily and quickly into wood of various varieties and diameters so as to split the wood, such as logs, with a minimum of force, and without hang-up of the tool.

While preferred embodiments of the invention have been illustrated and described, it will be understood that various changes and modifications may be made. For example, the multiple wedge angles and the widths of the successive wedging surfaces may be modified without departing from the spirit of the invention.

What is claimed is:

1. A wood splitting tool comprising, in combination, a body portion of generally wedge shaped configuration and including a top surface, a pair of spaced end surfaces and a pair of oppositely angularly inclined side surfaces, said oppositely angularly inclined side surfaces of said body portion terminating in a relatively sharp edge, said tool also including a pair of flank portions disposed on said oppositely angularly inclined side surfaces of said body portion intermediate said end surfaces of said body portion, each of said flank portions including a top surface, spaced substantially parallel end surfaces of generally obtuse triangular configuration and an angularly inclined side surface, the width of said angularly inclined side surface of each of said flank portions being less than the width of said side surfaces of said body portion, the junctions of said side surfaces of said flank portions with said side surfaces of said body portion extending in a direction substantially parallel to said sharp edge, one of said flank portions being longitudinally offset on said body portion with respect to the other flank portion whereby the apex of said one flank portion is spaced longitudinally of said body portion with respect to the apex of said other flank portion, said top surfaces of said flank portions projecting outwardly from said side surfaces of said body portion beyond said top surface of said body portion whereby said flank portions provide clearance for said top surface of said body portion permitting impact forces to be applied to said top surface of said body portion to drive said sharp edge through a log when said tool is disposed completely within such log.

2. The combination as set forth in claim 1 wherein the included angle between said side surfaces of said body portion adjacent said flank portions is less than the included angle between a side surface of said body portion and the side surface of the flank portion adjacent thereto.

3. The combination as set forth in claim 1 wherein said flank portions are disposed on said oppositely angularly inclined side surfaces of said body portion substantially equally spaced from said end surfaces of said body portion.

4. The combination as set forth in claim 1 wherein said side surfaces of said flank portions slope at substantially equal opposite angles.

5. The combination as set forth in claim 1, said side surfaces of said body portion and the adjacent side surfaces of said flank portions defining a continuous elongate groove on each side of said tool.

6. The combination as set forth in claim 5, wherein the grooves defined by said side surfaces of said body portion and said flank portions are V-shaped in transverse cross section.

7. The combination as set forth in claim 1 including handle means secured to said body portion.

8. A unitary wood splitting tool comprising, in combination, a body portion of generally wedge shaped configuration, said body portion including a top surface, a pair of spaced end surfaces and a pair of oppositely angularly inclined side surfaces, said oppositely angularly inclined side surfaces of said body portion sloping toward each other and terminating in a relatively sharp edge, said tool also including a pair of flank portions disposed on said oppositely angularly inclined side surfaces of said body portion intermediate and substantially equally spaced from said end surfaces of said body portion, each of said flank portions including a top surface, spaced substantially parallel end surfaces of generally obtuse triangular configuration and an angularly inclined side surface, the junctions of said side surfaces of said flank portions with said side surfaces of said body portion extending in a direction substantially parallel to said sharp edge, one of said flank portions being longitudinally offset on said body portion with respect to the other flank portion whereby the apex of said one flank portion is spaced longitudinally of said body portion with respect to the apex of said other flank portion, said top surfaces of said flank portions projecting outwardly from said side surfaces of said body portion beyond said top surface of said body portion whereby said flank portions provide clearance for said top surface of said body portion permitting impact forces to be applied to said top surface of said body portion to drive said sharp edge into a log when said top surface of said tool is disposed completely within such log.

9. The combination as set forth in claim 8, wherein the width of said side surfaces of each of said flank portions is less than the width of said side surfaces of said body portion.

10. The combination as set forth in claim 8, wherein the included angle between said side surfaces of said body portion is less than the included angle between one side surface of said body portion and the side surface of the flank portion adjacent thereto.

11. The combination as set forth in claim 8, said side surfaces of said body portion and the adjacent side surfaces of said flank portions defining elongate grooves aligned with each other.

12. The combination as set forth in claim 11 wherein the grooves defined by said side surfaces of said body portion and said flank portions taper toward said relatively sharp edge.

13. The combination as set forth in claim 12 including handle means secured to said body portion.

14. A wood splitting tool comprising, in combination, an elongate body portion of wedge shaped configuration and including a top surface, a pair of spaced substantially parallel end surfaces of generally isosceles triangular configuration and a pair of oppositely angularly inclined side surfaces; said oppositely angularly inclined side surfaces of said body portion sloping toward each other and terminating in a relatively sharp edge at the apex of said end surfaces; said tool also including a pair of flank portions disposed on said oppositely angularly inclined side surfaces of said body portion intermediate said end surfaces; each of said flank portions including a top surface, a pair of spaced substantially parallel end surfaces of generally obtuse triangular configuration and an angularly inclined side surface; the top surfaces of said flank portions being disposed in spaced relationship with respect to said top surface of said body portion at a position intermediate said top surface of said body portion and said relatively sharp edge, the junctions of said side surfaces of said flank portions with said side surfaces of said body portion extending in a direction substantially parallel to said sharp edge, one of said flank portions being longitudinally offset on said body portion with respect to the other flank portion whereby the apex of said one flank portion is spaced longitudinally of said body portion with respect to the apex of said other flank portion, said top surfaces of said flank portions projecting outwardly from said side surfaces of said body portion beyond said top surface of said body portion whereby said flank portions provide clearance for said top surface of said body portion permitting impact forces to be applied to said top surface of said body portion to drive said sharp edge into a log when said tool is disposed completely within such log.

15. The combination as set forth in claim 14 wherein said top surfaces of said flank portions are disposed in spaced relationship with respect to each other.

16. The combination as set forth in claim 15 wherein said flank portions are disposed on said oppositely angularly inclined side surfaces of said body portion substantially equally spaced from said end surfaces of said body portion.

17. The combination as set forth in claim 16 wherein said side surfaces of said flank portions slope at substantially equal opposite angles.

18. The combination as set forth in claim 17, wherein the width of said side surfaces of each of said flank portions is approximately one-third the width of said side surfaces of said body portion.

19. A wood splitting tool comprising, in combination, a body portion of generally wedge shaped configuration and including a top surface, a pair of end surfaces and a pair of oppositely angularly inclined side surfaces; said oppositely angularly inclined side surfaces of said body portion sloping toward each other and terminating in a relatively sharp edge; said tool also including a pair of flank portions disposed on said oppositely angularly inclined side surfaces of said body portion intermediate said end surfaces; each of said flank portions including a top surface, a pair of spaced substantially parallel end surfaces of generally obtuse triangular configuration and an angularly inclined side surface; the top surface of one of said flank portions being disposed in spaced relationship with respect to said top surface of said body portion at a position intermediate said top surface of said body portion and said relatively sharp edge, the junctions of said side surfaces of said flank portions with said side surfaces of said body portion extending in a direction substantially parallel to said sharp edge, said one flank portion being longitudinally offset on said body portion with respect to the other flank portion whereby the apex of said one flank portion is spaced longitudinally of said body portion with respect to the apex of said other flank portion, said top surfaces of said flank portions projecting outwardly from said side surfaces of said body portion beyond said top surface of said body portion whereby said flank portions provide clearance for said top surface of said body portion permitting impact forces to be applied to said top surface of said body portion to drive said sharp edge into a log when said top surface of said body portion is disposed completely within such log.

20. The combination as set forth in claim 19 wherein said top surfaces of said flank portions are disposed in spaced relationship with respect to each other.

21. The combination as set forth in claim 20 wherein said flank portions are disposed on said oppositely angularly inclined side surfaces of said body portion substantially equally spaced from said end surfaces of said body portion.

22. The combination as set forth in claim 21 wherein said side surfaces of said flank portions slope at substantially equal opposite angles.

23. The combination as set forth in claim 22 wherein the width of said side surfaces of each of said flank portions is less than the width of said side surfaces of said body portion.

24. The combination as set forth in claim 23, said body portion defining an internal passageway, and handle means having a portion thereof disposed in the passageway defined by said body portion.

* * * * *